US010465508B2

(12) United States Patent
Sitka et al.

(10) Patent No.: US 10,465,508 B2
(45) Date of Patent: Nov. 5, 2019

(54) METHOD AND APPARATUS FOR GENERATING PULSES IN A FLUID COLUMN

(71) Applicant: Halliburton Energy Services, Inc., Houston, TX (US)

(72) Inventors: Mark Anthony Sitka, Richmond, TX (US); Larry DeLynn Chambers, Kingwood, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/119,817

(22) PCT Filed: May 14, 2014

(86) PCT No.: PCT/US2014/000103
§ 371 (c)(1),
(2) Date: Aug. 18, 2016

(87) PCT Pub. No.: WO2015/174951
PCT Pub. Date: Nov. 19, 2015

(65) Prior Publication Data

US 2017/0051610 A1 Feb. 23, 2017

(51) Int. Cl.
*G01V 3/00* (2006.01)
*E21B 47/18* (2012.01)
(Continued)

(52) U.S. Cl.
CPC ..... *E21B 47/18* (2013.01); *E21B 47/011* (2013.01); *E21B 47/12* (2013.01); *E21B 47/14* (2013.01); *E21B 47/16* (2013.01)

(58) Field of Classification Search
CPC ..... E21B 47/16; E21B 47/14; E21B 47/18; E21B 47/12; E21B 47/011; E21B 47/122;
(Continued)

(56) References Cited

U.S. PATENT DOCUMENTS 4,790,393 A 12/1988 Larronde et al.
4,869,100 A 9/1989 Birdwell
(Continued)

FOREIGN PATENT DOCUMENTS

GB 2009473 A 6/1979
RU 2179623 C2 2/2002
(Continued)

OTHER PUBLICATIONS

Office Action issued for Russian Patent Application No. 525566ru2016147358, dated Dec. 6, 2017, 10 pages.
(Continued)

*Primary Examiner* — Munear T Akki

(57) ABSTRACT

Methods and apparatus are disclosed for generating fluid pulses in a fluid column, such as within a well. A described example fluid pulse generator has a valve member comprising a piston that is linearly movable within a piston chamber to control flow by selectively obstructing a fluid passage. The fluid passage may extend around at least a portion of the piston chamber and intersect at an angle relative to the axis of movement of the valve member. The piston is linearly movable, such as from a closed or minimal-flow position to a maximal-flow position, and optionally to any of a number or range of positions therebetween. The position of the valve member may be varied to generate fluid pulses of a selected pattern of duration, amplitude, and so forth, to generate a signal within the fluid column detectable at a location remote from the fluid pulse generator.

30 Claims, 10 Drawing Sheets

(51) Int. Cl.

| | |
|---|---|
| ***E21B 47/14*** | (2006.01) |
| ***E21B 47/12*** | (2012.01) |
| ***E21B 47/16*** | (2006.01) |
| ***E21B 47/01*** | (2012.01) |

(58) Field of Classification Search

CPC ..... G01V 11/002; G01V 1/40; G01V 1/50; G01V 1/44; G01V 1/46

USPC ..... 340/853.4, 855.4; 367/85; 175/38, 48, 175/56

See application file for complete search history.

(56) References Cited

U.S. PATENT DOCUMENTS

| | | | | |
|---|---|---|---|---|
| 5,473,579 | A * | 12/1995 | Jeter | E21B 47/187 175/50 |
| 5,740,127 | A * | 4/1998 | Van Steenwyk | E21B 47/187 175/40 |
| 5,806,611 | A | 9/1998 | Van Den Steen et al. | |
| 6,053,261 | A * | 4/2000 | Walter | E21B 4/14 175/234 |
| 6,237,701 | B1 * | 5/2001 | Kolle | E21B 7/18 175/1 |
| RE40,944 | E | 10/2009 | Seyler et al. | |
| 8,203,908 | B2 | 6/2012 | Pratt et al. | |
| 2002/0159333 | A1 * | 10/2002 | Hahn | G01V 1/50 367/35 |
| 2002/0170424 | A1 * | 11/2002 | Brown | F15B 11/024 91/444 |
| 2004/0202047 | A1 * | 10/2004 | Fripp | B06B 1/06 367/81 |
| 2005/0260089 | A1 | 11/2005 | Hahn et al. | |
| 2008/0169354 | A1 * | 7/2008 | Bankers | A01M 1/2044 239/6 |
| 2010/0110833 | A1 | 5/2010 | Close | |
| 2011/0011594 | A1 | 1/2011 | Youn et al. | |
| 2013/0306319 | A1 | 11/2013 | Kolle | |
| 2015/0075867 | A1 * | 3/2015 | Eddison | E21B 28/00 175/56 |
| 2015/0275660 | A1 * | 10/2015 | Logan | E21B 47/06 175/48 |
| 2016/0010449 | A1 * | 1/2016 | Liu | E21B 47/187 166/250.01 |
| 2017/0260853 | A1 * | 9/2017 | Stack | F01C 1/02 |

FOREIGN PATENT DOCUMENTS

| | | |
|---|---|---|
| RU | 2383731 C2 | 3/2010 |
| SU | 1243633 A3 | 7/1986 |
| SU | 1490268 A1 | 6/1989 |

OTHER PUBLICATIONS

Search Report issued for Russian Patent Application No. 525566ru2016147358, dated Dec. 5, 2017, 2 pages.

"International Application Serial No. PCT/US2014/000103, International Search Report dated Feb. 10, 2015", 3 pgs.

"International Application Serial No. PCT/US2014/000103, Written Opinion dated Feb. 10, 2015", 13 pgs.

* cited by examiner

METHOD AND APPARATUS FOR GENERATING PULSES IN A FLUID COLUMN

RELATED APPLICATIONS

This application is a U.S. National Stage Filing under 35 U.S.C. 371 of International Patent Application Serial No. PCT/US2014/000103, filed May 14, 2014, and published on Nov. 19, 2015 as WO 2015/174951 A1, the benefit of priority of which is claimed hereby and which is incorporated by reference herein in its entirety.

BACKGROUND

This disclosure relates generally to methods and apparatus for generating pulses in a fluid column, as may be used for telemetry between a surface location and downhole instrumentation within a subterranean well.

Drilling fluid circulated down a drill string to lubricate the drill bit and remove cuttings is typically broadly referred to as drilling "mud." The use of pulses in a drilling fluid column is typically termed "mud pulse telemetry." Numerous fluid pulsing systems have been used for generating such pulses in the fluid column. Such systems include various forms of valve mechanisms to produce fluid pulses. A "poppet" valve, for example, may have a valve member that linearly reciprocates, to open and close a fluid passageway. A rotary valve, by comparison, may have a rotor that rotates to selectively control flow to a fluid passageway. A rotary valve may either rotate reciprocally, to relatively open and close a fluid passage to generate pulses, or continually, wherein the speed of the rotor may be varied to facilitate pulses at a momentary selected frequency to execute a desired communication protocol. Each of these systems offers various features and characteristics.

BRIEF DESCRIPTION OF THE DRAWINGS

FIG. 2A-C depict example structures for use in generating fluid pulses; wherein FIG. 2A schematically depicts an illustrative example valve assembly in an "open" position, and FIG. 2B schematically depicts the example valve assembly of FIG. 2A in a "closed" position; while FIG. 2C depicts an example embodiment of a mud pulse generator, including an example valve assembly, depicted partially in vertical section.

DETAILED DESCRIPTION

Figure 1:
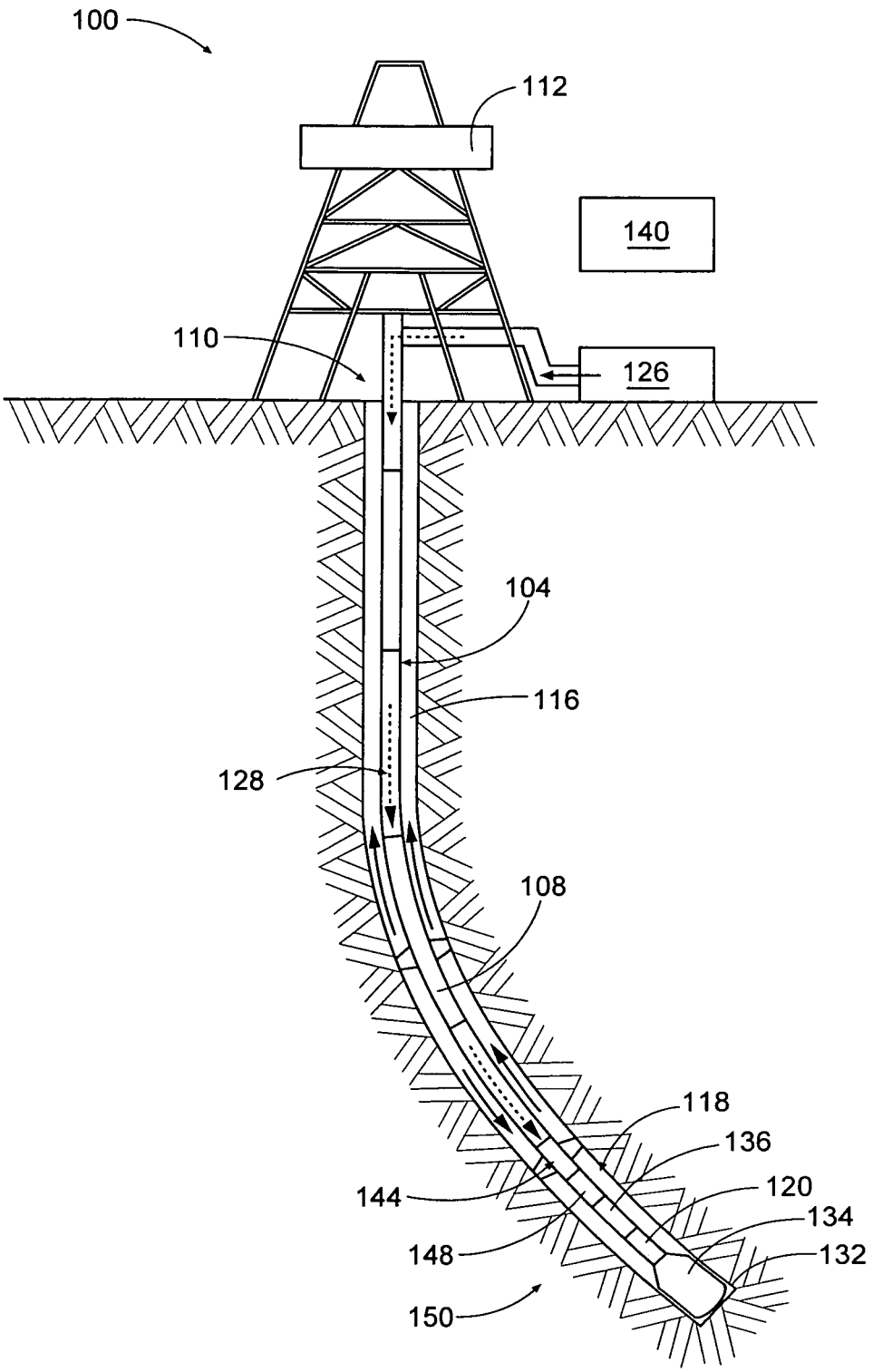
FIG. 1 depicts is a schematic representation of an exemplary tool string within a wellbore, the tool string including a mud pulse generator in accordance with the present disclosure.

The present disclosure includes new methods and apparatus for generating fluid pulse telemetry signals, wherein a linearly moving valve member, such as a piston, moves within a piston chamber defined at least in part by a surface, to selectively obstruct fluid flow and thereby control a rate of fluid flow through openings in that surface. The surface opening(s) may represent or be defined by the respective intersection of one or more fluid flow passage(s) with the piston chamber. In some example embodiments, the fluid flow passage will extend around a portion of the piston chamber, to intersect a downstream portion of the piston chamber. In some example embodiments, the piston will move along a linear axis and the fluid flow passage will intersect the piston chamber surface at an angle relative to that linear axis of movement.

The linearly moving valve member may fully, or at least partially, obstruct flow to, or from, the fluid flow passage when in a first position (i.e., to close or at least reduce flow relative to a second position) and to allow and/or increase flow to, or from, the fluid flow passage when moved from the first position to the second position. This description is not intended to limit the linearly moving valve member to having two positions, nor to only discrete positions. Rather, in at least some embodiments, the linearly moving valve member may be varied over a range of positions to selectively obstruct the fluid passage and thus vary fluid flow by an amount that varies with position of the linearly moving valve member and corresponding obstruction of the fluid flow passage.

In some embodiments, the moveable valve member will include a closure member configured to open or close flow through one or fluid flow passages in a desired manner. In some embodiments, the valve closure member will generally open or close a fluid passage that is radially disposed relative to the axis of linear movement of the valve member. In some embodiments, the piston chamber will have a region with surfaces defining a generally uniform bore for a selected distance, and the valve will include one or more fluid passages that extend to opening(s) in a that surface, and the closure member is linearly moveable within the bore to open or close fluid flow through the openings.

The following detailed description describes example embodiments of the new mud pulse generator and associated methods with reference to the accompanying drawings, which depict various details of examples that show how the disclosure may be practiced. The discussion addresses various examples of novel methods, systems and apparatus in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

A mud pulse generator as described herein will be used to generate pulses in a fluid column within a downhole well to facilitate "mud pulse telemetry." This terminology embraces communication through pulses in a fluid column of any kind of well servicing fluid (or produced fluid) that may be in a well. One example of such use is for the mud pulse generator to be placed in a drillstring along with MWD (or LWD) tools, to communicate data from the MWD/LWD tools upwardly and to the surface through the fluid column flowing downwardly through the drillstring to exit the drill bit. The pulses will be detected and decoded at the surface, thereby communicating data from tools or other sensors in the bottom whole assembly, or elsewhere in the drillstring. The described example mud pulse generator relatively open and closes fluid passages to create pulses in the fluid column of a selected duration and pattern which are detectable at the surface. In other contemplated systems, a mud pulse generator as described may be placed proximate the surface for providing downlink pulse communication to a downhole tool.

Referring now to FIG. 1, the figure schematically depicts an example directional drilling system 100 configured to form wellbores at a variety of possible trajectories, including those that deviate from vertical. Directional drilling system 100 includes a land drilling rig 112 to which is attached a drill string, indicated generally at 104, with a bottom hole assembly, indicated generally at 144 (hereinafter BHA), in accordance with this disclosure. The present disclosure is not limited to land drilling rigs, and example systems according to this disclosure may also be employed in drilling systems associated with offshore platforms, semi-submersible, drill ships, and any other drilling system satisfactory for forming a wellbore extending through one or more downhole formations. Drilling rig 112 and associated surface control and processing system 140 can be located proximate the well head 110 at the Earth's surface. Drilling rig 112 can also include a rotary table and rotary drive motor (not specifically depicted), and other equipment associated with rotation or other movement of drill string 104 within wellbore 116. Other components for drilling and/or managing the well, such as blow out preventers (not expressly shown) will also be provided proximate well head 110. An annulus 118 is formed between the exterior of drill string 104 and the formation surfaces defining wellbore 116.

One or more pumps will be provided to pump drilling fluid, indicated generally at 128, from a fluid reservoir 126 to the upper end of drill string 104 extending from well head 110. Return drilling fluid, formation cuttings, and/or downhole debris from the bottom end 132 of wellbore 116 will return through the annulus 118 through various conduits and/or other devices to fluid reservoir 126. Various types of pipes, tubing, and/or other conduits may be used to form the complete fluid paths.

BHA 106 at the lower end of drill string 104 terminates in a drill bit 134. Drill bit 134 includes one or more fluid flow passageways with respective nozzles disposed therein. Various types of well fluids can be pumped from reservoir 126 to the end of drill string 104 extending from wellhead 110. The well fluid(s) flow through a longitudinal bore (not expressly shown) in drill string 104, and exit from nozzles formed in drill bit 134. During drilling operations drilling fluid will mix with formation cuttings and other downhole debris proximate drill bit 134. The drilling fluid will then flow upwardly through annulus 118 to return the formation cuttings and other downhole debris to the surface. Various types of screens, filters, and/or centrifuges (not expressly shown) will typically be provided to remove formation cuttings and other downhole debris prior to returning drilling fluid to reservoir 126.

Bottom hole assembly (BHA) 106 can include various components, for example one or more measurement while drilling (MWD) or logging while drilling (LWD) tools 136, 148 that provide logging data and other information to be communicated from the bottom of wellbore 116 to surface equipment 108. In this example string, BHA 106 includes mud pulse generator 144 to provide mud pulse telemetry of such data and/or other information through the fluid column within the drill string to a surface receiver location, for example, proximate the wellhead 110. Mud pulse generator 144 will be constructed in accordance with the example device of FIG. 2 and/or any of the other example embodiments described herein. At the surface receiver location, the pressure pulses in the fluid column will be detected and converted to electrical signals for communication to surface equipment, and potentially from there to other locations.

The communicated logging data and/or other information communicated to a receiver uphole can then be communicated to a data processing system 140. Data processing system 140 can include a variety of hardware, software, and combinations thereof, including, e.g., one or more programmable processors configured to execute instructions on and retrieve data from and store data on a memory to carry out one or more functions attributed to data processing system 140 in this disclosure. The processors employed to execute the functions of data processing system 140 may each include one or more processors, such as one or more microprocessors, digital signal processors (DSPs), application specific integrated circuits (ASICs), field programmable gate arrays (FPGAs), programmable logic circuitry, and the like, either alone or in any suitable combination.

For some applications, data processing system may have an associated printer, display, and/or additional devices to facilitate monitoring of the drilling and logging operations. For many applications, outputs from data processing system will be communicated to various components associated with operating drilling rig 112 and may also be communicated to various remote locations monitoring the performance of the operations performed through directional drilling system 100.

Figure 2A:
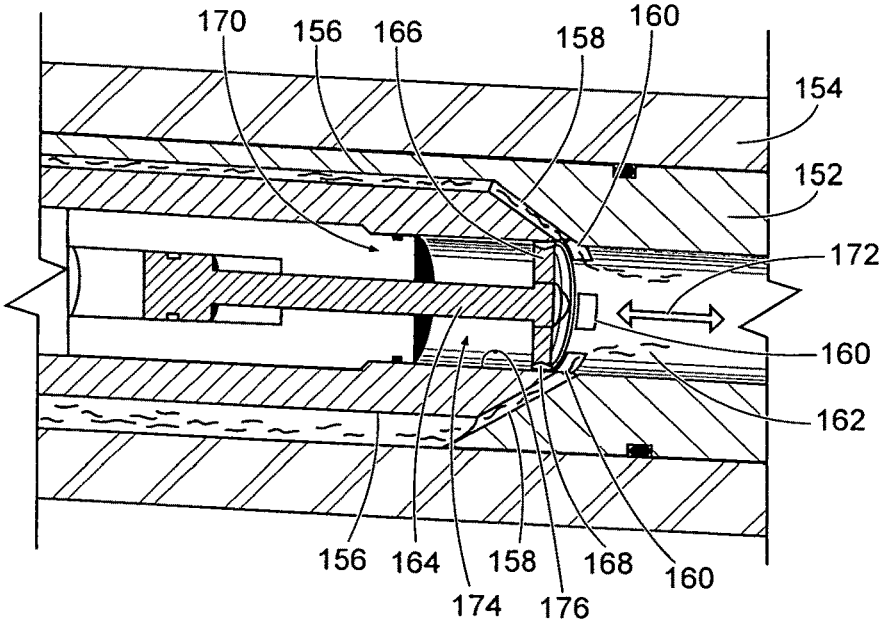

Referring now to FIG. 2A, the figure schematically depicts an example valve mechanism 150 illustrated in simplified form, to depict the movement and function of the valve closure mechanism. The mechanism 150 includes a ported sub 152 within a housing 154. In this example configuration, ported sub 152 in combination with housing 154 defines a plurality of fluid flow passages, which include channels 156. In many examples, channels 156 are in fluid communication with a fluid-containing annular region (not depicted in this figure) above the valve mechanism within housing 154, through which well fluids are pumped. The fluid flow passages further include radially extending passages 158 that each communicating with a channel 156 and extend to intersect a central bore 162, through which fluid will flow. Central bore 162 is a downstream portion of a chamber, indicated generally at 174, containing a longitudinally movable valve member, here in the form of a piston 164 configured for reciprocating movement in response to a drive mechanism 170. Each radially extending passage 158 terminates at an opening 160 in a surface 176 defining central bore 162 of piston chamber 174. The fluid flow passages will be sized to allow passage of anticipated particulates that may be dispersed in a drilling fluid, such as various forms of "lost circulation materials" that may be introduced into a fluid to address fluids being lost into formations penetrated by the wellbore.

In the depicted example, drive mechanism 170 can be of any of a variety of mechanisms, such as mechanical, electrical, hydraulic mechanisms, etc., and thus is depicted generically in the figure. As will be described later herein, electrical mechanisms are believed to be well suited as drive mechanisms, and example alternatives for electromagnetic drive mechanisms are discussed later herein.

In this example, piston 164 includes a radially enlarged closure member, indicated generally at 166. Closure member 166 includes a radially outward surface 168. Piston 164 is linearly movable between at least first and second positions along a longitudinal axis of movement 172, and may be movable relative to one or more additional positions between the first and second positions or to one side of either of those first and second positions. In FIG. 2A, piston 164 is in a relatively retracted position, in which valve assembly is "open," because outward surface 168 of closure member 166 is longitudinally above (or "uphole") of openings 160, and thus openings 160 are unobstructed, to provide free flow of fluid from channels 156, through passages 158 and associated openings 160, into central bore 162 of the piston chamber.

Figure 2B:
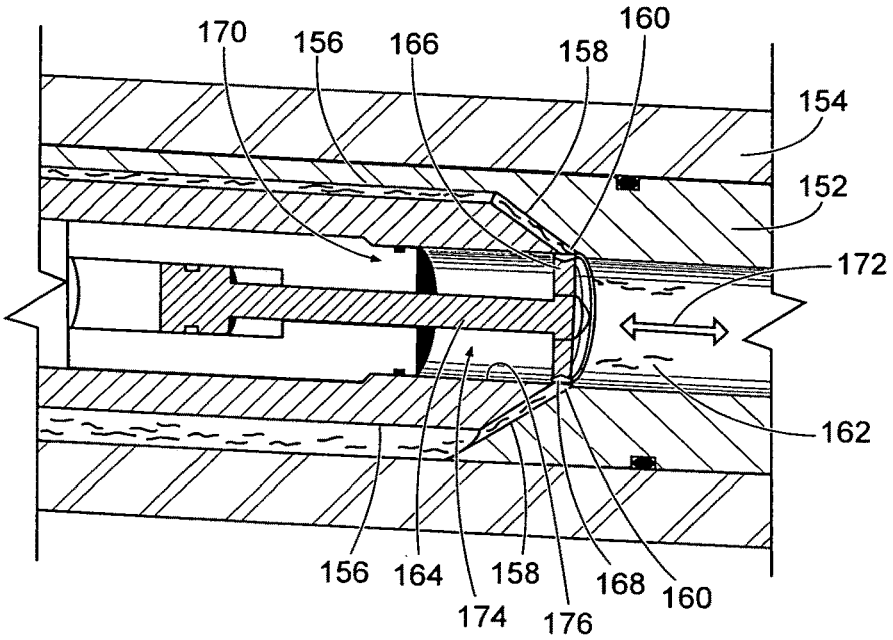

Referring now also to FIG. 2B, that figure depicts the piston 164 in a second longitudinal position, in which the piston 164 is relatively extended, and the valve mechanism 150 is "closed" by virtue of the radially outward surface 168 of closure member 166 being longitudinally adjacent openings 160 to relatively restrict, or block, fluid flow from passages 158 into central bore 162. For purposes of generating fluid pulses, complete blockage or "sealing" of openings 160 is not required. In this example, closure member 166 has openings within the perimeter defined by outward surface 168 to allow closure member 166 to reciprocate through fluids with less resistance; and surfaces of closure member 166 may be configured to minimize such resistance. In this example, piston 164 moves linearly relative to flow flowing radially inwardly, at an angle relative to the axis of movement 172. Thus, in this example configuration, valve mechanism 150 operates primarily in shear relative to the flowing fluid, and movement of piston 164 does not have to overcome the weight of the fluid column above valve mechanism in either direction of reciprocating movement.

Figure 2C:
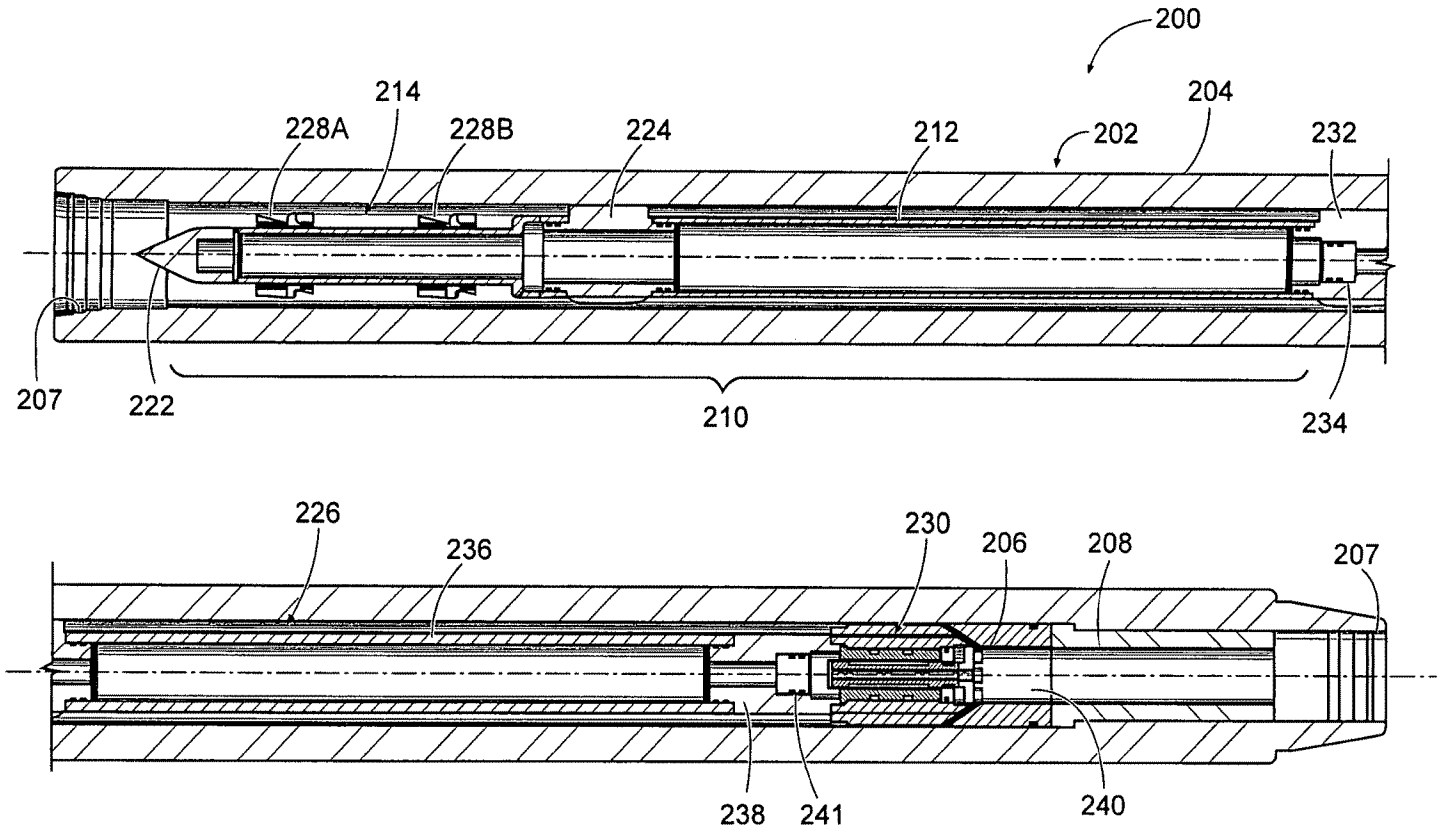

Referring now to FIG. 2C, that figure depicts an example mud pulse generator 200, depicted partially in vertical section. Mud pulse generator 200 will use a valve assembly that operates generally in accordance with the schematic example above (which may be implemented in a variety of configurations, including but not limited to example configurations as described herein). In this example, mud pulse generator 200 includes a housing assembly 202, which in this example, includes an outer housing 204 having box and pin connections 206, 207, respectively, at the upper and lower ends, as well as a central insert 206 and an exit bore insert 208 as will be further discussed later herein in reference to FIG. 3A.

Mud pulse generator 200 includes three primary assemblies that will be discussed below: a power source for operating the device (in this example, a generator assembly, indicated generally at 210); an electronics section 226 and a valve assembly 230. Generator assembly 210 includes a generator section, indicated generally at 212, which will include a stator and rotor (not specifically Illustrated) cooperatively configured to generate electrical current for use by mud pulse generator 200 in response to rotation of the rotor relative to the stator. Generator assembly 212 also includes, in this example, a multi-stage adjustable flow gear 214, comprising a plurality of vanes configured to engage fluid flowing downwardly in annulus 216 surrounding generator assembly 210 within outer housing 204, and gearing for coupling to generator 212. Flow gear 214 is operatively coupled to the rotor of the generator 212 to cause rotation thereof to generate the electrical current. At an upper end, generator assembly 210 includes a tapered nose 222 to direct fluid flow to the annulus 216, where the fluid will engage the vanes of the first and second stages, 228A, 228B, respectively. In some systems, tapered nose 222, or another component in its place, may be configured to facilitate connections to another tool, such as any one or more of electrical, optical, hydraulic, pneumatic, and/or mechanical connections (as discussed herein in reference to FIG. 6). In this example, a centralizer 224 is coupled between flow gear 214 and generator 212 to keep the generator assembly 210 centralized within outer housing 204, thereby defining a portion of an annulus 216 surrounding generator assembly 210 within outer housing 204.

In this example, mud pulse generator 200 includes an electronics section 226 beneath generator assembly 210, and operatively coupled thereto. Again, a centralizer 232 is located between generator assembly 210 and electronics section 226. Due to the communication of electrical current between the generator and the electronics section, a hermetic seal 234 will be provided between the two sections. In the depicted example, the seal is located within the centralizer 232, but can alternatively be located in either the generator assembly 210 or electronics section 226, or in another intervening component.

Electronics section 226 will typically include a sealed housing 236 to isolate the contained circuitry and components from the exterior environment. In this example, electronics section 226 includes both an electrical storage mechanism for receiving electrical current produced by generator assembly 210 and control circuitry for operating mud pulse generator 200.

Figure 8:
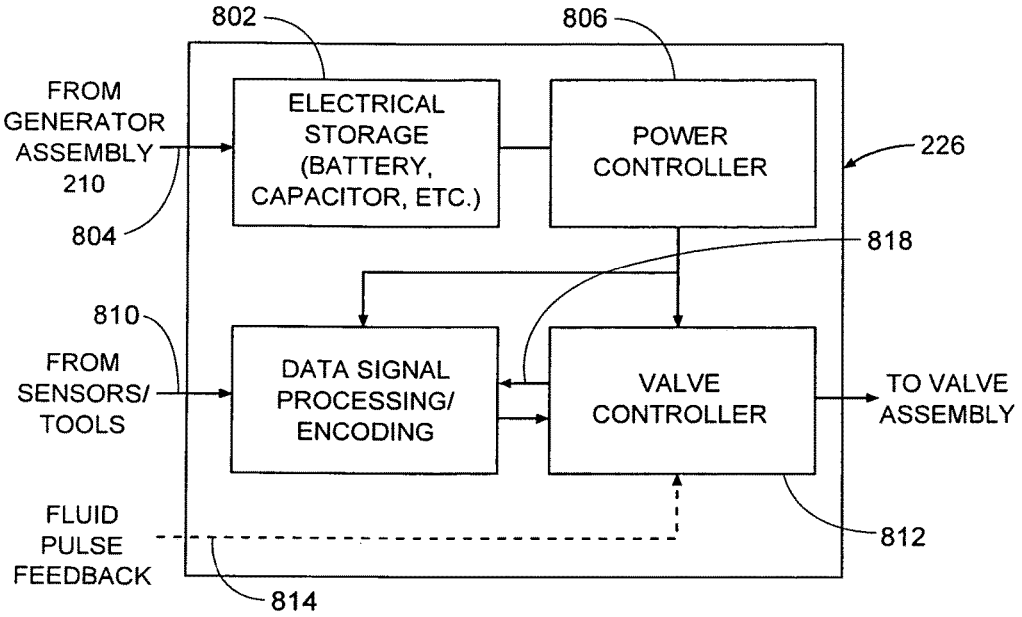
FIG. 8 depicts a block diagram of an example electronics section suitable for use in the mud pulse generator of FIG. 2C.

Referring now to FIG. 8, that figure depicts a block diagram representation of an example electronics section 226 suitable for use as a component of mud pulse generator 200. As shown in that figure, electronics section 226 includes an electrical storage device 802, in this example, coupled to receive an input 804 of electrical current from generator assembly 210. Electrical storage device 802 may be of any known type suitable for the requirements of the remainder of mud pulse generator 200, such as a battery or capacitor. Electronics section 226 also includes a power controller 806 operatively coupled to electrical storage device 802. Power controller 806 is typically structured to perform a number of functions, including regulation of the voltage and/or current supplied to other components. This power regulation will often include various forms of filtering of the electrical signal to remove noise or other anomalies. Although power controller 806 is depicted as being downstream from electrical storage device 802, many functions of the controller may be performed before the electrical signal from generator 212 is coupled to the electrical storage device 802, and thus the current from generator 212 may be coupled to power controller 806 instead of electrical storage device 802. In such configurations, power controller 806 may also include appropriate battery/storage management functionality.

Electrical current will be communicated from either power controller 806 or electrical storage device 802 to other electrical components in the system. In the depicted example, these include a data signal processing/encoding module 808 providing functionality as described later herein in reference to FIG. 6, to receive one or more data signals through one or more inputs, as indicated at 810, and to prepare such signal(s) for communication through a series of mud pulses. Once a portion of a data stream is ready for transmission, the data stream will be communicated to a valve controller 812 to provide appropriate control signals to the valve assembly 230.

In some example systems, one or more feedback signals are received at an input 814 and used to optimize the performance of mud pulse generator 200, such as through adjustment of the operation of the valve controller 812. Such feedback signal can be from a variety of potential sources. For example, one or more sensors may be located relatively uphole in the tool string containing mud pulse generator 200 where they can sense the generated pulses or other conditions in the wellbore to provide appropriate feedback signal. Such a feedback signal may be analyzed within the valve controller 812 to adjust operation of the valve. For example, if the analysis of the feedback signal were to indicate less than a desired threshold of pulse identification or discrimination, valve controller 812 can be actuated to adjust the valve operation, for example by controlling the valve either to reduce the transmission rate (and possibly expand the pulse duration) and/or to increase the pulse amplitude. In some situations, valve controller 812 might determine that a different communication protocol would be better suited to existing downhole conditions, and can communicate (as indicated at 818) to data signal processing/encoding module 808 an instruction to make such change.

Other sources of feedback signals are also contemplated. For example, feedback might be obtained from the pulse receiver proximate the wellhead, and communicated downhole by any suitable mechanism, such as a fluid pulse downlink, wired pipe, or a communication channel including some portion which is a wireless communication link. Further, in addition to sensing fluid pulses, other types of sensors might be utilized, such as acoustic sensors for sensing noise in the wellbore, vibration or other movement sensors (for example, accelerometers) sensing movement associated with the tool string, etc.

In order to provide the described functionality, the electronics section 226 will typically include one or more processing resources such as a programmable processor or a controller, and where a programmable device is used, may also include random access memory (RAM), hardware and/or software control logic, other storage for containing data and/or operating instructions, read only memory (ROM), and/or other types of nonvolatile memory. For purposes of this disclosure, all such memory devices, whether volatile or non-volatile, and storage drives are considered non-transitory storage devices. In addition, electronics section 226 comprises suitable interface circuits 820 for communicating and receiving data from sensors located at the surface and/or downhole, and may include one or more ports for communicating with external devices, as well as any additional necessary input and output (I/O) devices.

In one example, electronics section 226 has programmed instructions stored in the memory that when executed performs the described control operations. While the described functionalities of electronics system are described and depicted as separate in reference to FIG. 8, such depiction is for clarity of description, any or all of such functionalities may be performed by a single processor or controller, if desired.

Referring again to FIG. 2C, in the depicted example, electronics section 226 is coupled to the valve assembly 230 through use of a connecting block 238 between the two units. Again, a hermetic seal 240 will be provided between the two units to isolate the electrical connections between the two components. Although in the depicted example, generator assembly 210 and electronics section 226 are depicted as being located up hole from the valve assembly 230, these components may instead be located downhole from the valve assembly 230. In other examples, the structure and functionality of electronics section 226 may be provided by two or more separate assemblies within a mud pulse generator, an example of which is discussed herein in reference to FIG. 7.

Figure 3A:
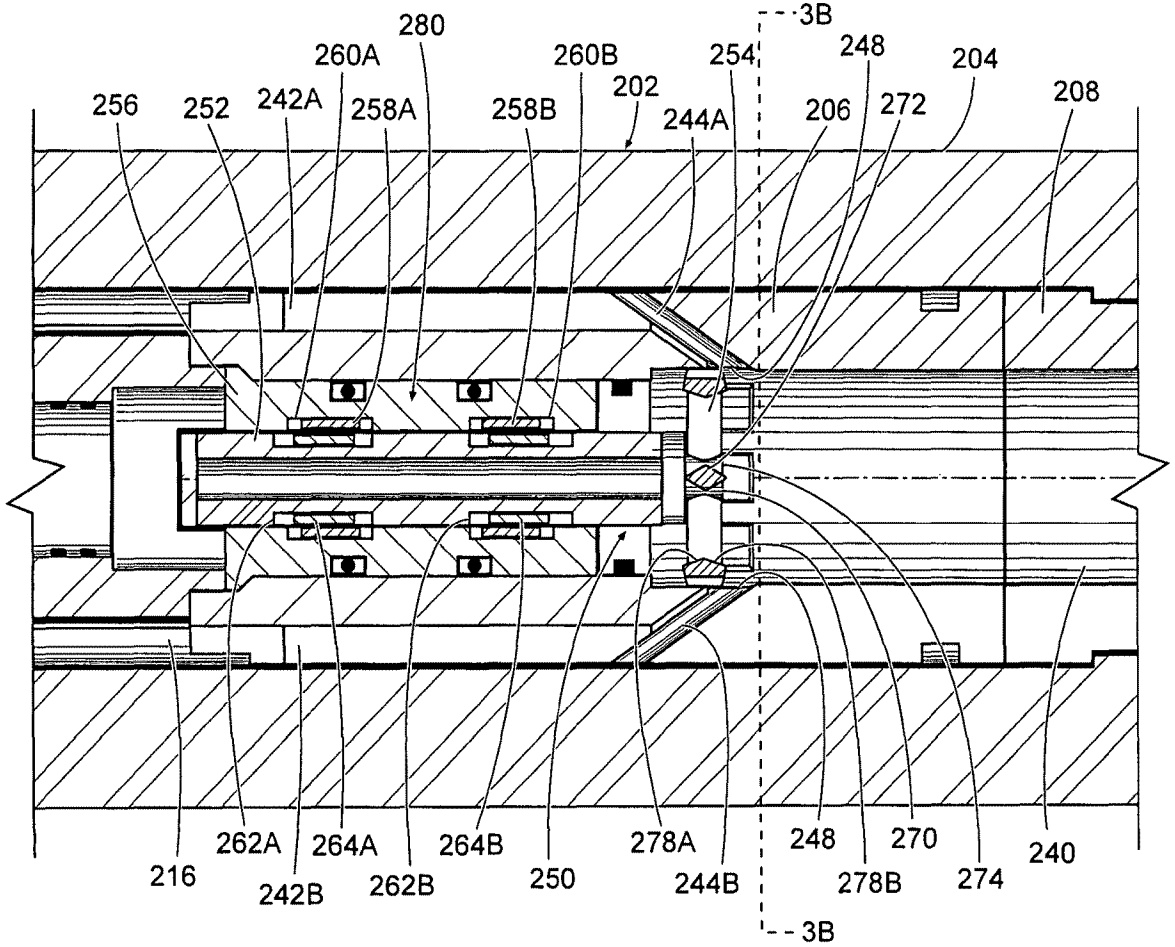
FIGS. 3A-B depict the valve assembly of the example mud pulse generator of FIG. 2C in greater detail, depicted in longitudinal cross-section in FIG. 3A, and in lateral cross-section in FIG. 3B.
Figure 3B:
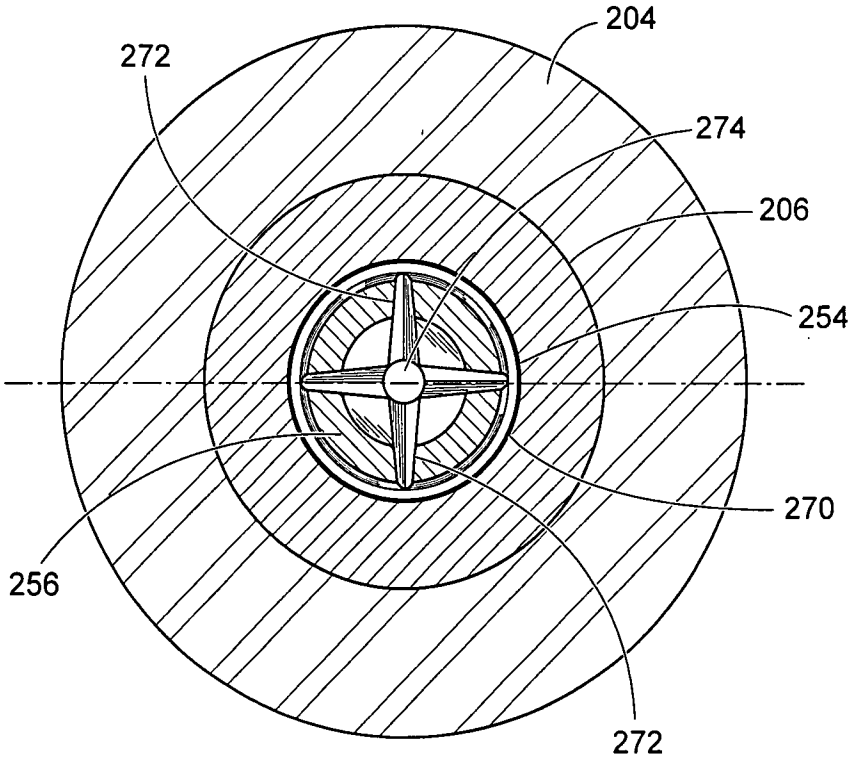

Referring now also to FIGS. 3A-B, FIG. 3A depicts valve assembly 230 in greater detail, and partially in longitudinal cross-section, while FIG. 3B depicts a lateral cross-section of valve assembly 230 through closure member 254. As can be seen in FIG. 3A, in this region, housing assembly 202 includes not only outer housing 204, but a central insert 206 and an exit bore insert 208. Central insert 206 sealingly engages the inner bore of outer housing 204. In a relatively upper section, central insert 206 includes a plurality of flutes around its outer surface extending generally to the inner diameter of outer housing 204 to define passageways 242A, 242B in communication with annulus 216 above. In a relatively lower portion, central insert includes a plurality of generally radially extending passageways 244A, 244B connecting the passageways 242A, 242B defined by said flutes within outer housing 204. In this example configuration, each passageway 244A, 244B terminates at a respective opening, each indicated at 248, to a central bore 240 in central insert 206. Passageways 244A, 244B will preferably extend at some angle relative to central bore 240. While this angle can be any that is desired, in many examples the included angle between each passageway 244A, 244B and a longitudinal axis through central bore 240 will be less than 90 degrees to minimize obstructions of fluid flow, and in many examples will be less than about 45 degrees, as in the depicted example.

Valve assembly 230 includes a valve member configured for linear, reciprocating motion within the valve assembly 230, which is identified as piston 250. In the depicted example, piston 250 is constructed of at least two parts, a drive member 252 and a closure member 254 coupled to the drive member 252 for movement together, so that the reciprocating motion of drive member 252 causes closure member 254 to move between one or more positions relatively in registry with openings 248, to relatively close the fluid path into central bore 240, and one or more positions relatively out of registry with openings 248 to relatively open the fluid path into central bore 240. Closure member 254 can be of many possible configurations that will restrict fluid between openings 248 and central bore 240 when in a first position, and will allow such fluid communication when in a second position. In the depicted example, closure member includes an outer ring 270 supported by a plurality of spokes 272 relative to a central hub 274. Central hub 274 facilitates the attachment of closure member 254 to drive member 252. Although closure member 254 has been described as a separate structure from drive member 252, in other examples both can be formed as a single component.

In the depicted example, the fluid will flow into central bore 240 from passageways 244A, 244B. However, configurations are possible which would allow the flow to be in the opposite direction, such as if the described components were reversed in orientation. The described configuration is desirable, however, as it removes the piston 250 from the pressure exerted by the fluid column in the tool string, and allows closure member to open and close the fluid passages while acting essentially in shear relative to the flowing fluid. Piston 250 being placed for movement outside of the fluid column allows easier movement in both directions, as the drive mechanism does not need to overcome the weight and force of the fluid column when moving in either direction. Examples of this configuration offer a significant advantage over valves with a moving structure member that is exposed to the fluid column above (such as conventional poppet valves), which have to overcome the weight and pressure of the column when moving in one of the two directions.

In the depicted example, outer ring 270 of closure member 254 has a circumferential periphery having a central section 276 having a generally cylindrical profile, providing a "sealing" surface. Closure member 254 is sized such that central section 276 provides a relatively small tolerance within central bore 256 to substantially block fluid flow between openings 248 and central bore 240. It should be understood that complete closure (i.e., literal "sealing") of the fluid flow passages is not necessary for the generation of the fluid pulses. In fact, in some examples, closure member 254 may be configured to leave "open" (i.e. unblocked) one or more openings 248 even when in a relatively "closed" position, so as to always allow some degree of fluid flow; or some fluid flow may be permitted through the dimensions of closure member 254 being selected to allow a desired gap, even when in registry with the openings (i.e., in a "closed" position). Thus, the "opening" and "closing" of the valve are not absolute terms, but are relative to one another, indicating permitting and obstructing fluid flow to a degree desired to generate fluid pulses, while meeting operations requirements of downhole operations (such as fluid flow to the drill bit during drilling operations).

In this example configuration, closure member 254 is configured to block all openings 248, and therefore has a continuous outer periphery. Outer ring 270 includes tapering sections 278A, 278B on each side of central section 276 tapering in the radially inward direction, which minimize fluid resistance to movement of closure member 254 in both directions. Additionally, the depicted tapers will assist in freeing closure member 254 from any solids which might otherwise become trapped and thereby block or impede movement of close member. Closure member 254 will preferably be constructed of a relatively lightweight material which is capable of withstanding the fluid pressures and downhole environments in which it will be used. One suitable material for closure member 254 is titanium, to minimize the mass of closure member 254 thereby facilitating relatively rapid reciprocal or other movement within central bore 240. Other suitable materials would be ceramic, stellite, and or tungsten carbide, each of which may offer particular advantages relative to specific downhole conditions).

A driver section, indicated generally at 280, is configured to move piston 250 back and forth along the linear path. Driver section 280 can be of many possible configurations, and may be operated for example either electrically or hydraulically. In the depicted example, driver section 280 is electrically operated. The drive mechanism may be a solenoid or other suitable mechanism, for example a voice coil selectively generating a magnetic field to interact with a magnetic field established by one or more permanent magnets to cause the reciprocating movement of piston 250. For this type of driver mechanism, the coils can be most easily placed in a valve housing 256 which will remain stationary relative to central insert 206, thereby facilitating the practical considerations of electrical connections from electronics section 226 to one or more coils 258A, 258B located in respective recesses 260A, 260B in the inner periphery of valve housing 256. The valve housing 256 will be formed of a non-magnetic material. Drive member 252 will include one or more recesses 262A, 262B extending at least partially around the periphery of drive member 252 with each recess housing one or more respective permanent magnets, indicated generally at 264A, 264B.

The described drive mechanism, using coils interacting with the magnetic fields established by permanent magnets can be implemented in ways that offer particular advantages. For example, as can be seen in driver section 280, no physical engagement with drive member 252 is required to cause the desired movement; and the movement will occur even with well fluids surrounding drive member 252 in valve housing 256. As a result, no dynamic seal is required between drive member 252 and valve housing 256 (or a similar structure). Such dynamic seals can, in some implementations, impede movement of a moving member (here, drive member 252) and/or serve as a potential point of failure. While such a dynamic seal could be added to driver section 280 if desired for some applications or configurations, in the depicted embodiment, one is not necessary for the described functioning of driver section 280.

A number of specific configurations for the coils and the permanent magnets are envisioned. In some cases, multiple coils may be actuated with opposite polarities of electrical current to generate the reciprocal movement of the piston 250. In other examples, however, each coil may be actuated with a single polarity of electrical current, with the change in direction achieved through orientation of the magnetic fields of the permanent magnets and the relative placement of the permanent magnets. In either type of system, multiple coils may be sequentially actuated to obtain the desired movement of the piston 250. In this example, the valve housing 256 and coils 258 extend concentrically around drive member 252. While this configuration offers advantages, it should be understood that other mechanisms may be used in which the coils or other electromagnetic structures are not concentric to drive member 252 but are placed relatively radially outwardly of drive member 252.

In the depicted embodiment of valve assembly 230, central bore 240 has a generally circular cross-section. However other configurations may be utilized, such as an oval cross-section to the bore, which could be utilized to prevent rotation of closure member 254, if such were desired for a particular implementation. Whatever the cross-sectional configuration of central bore 240, it will preferably have a generally uniform lateral cross-section (as depicted in FIG. 3B), at least across the intended range of travel of closure member 254.

In some configurations, valve assembly 230 as can be configured such that closure member 254 can reciprocate between a first position generally opening openings 248 for fluid flow and a second position generally closing openings 248 for fluid flow. In such configurations, closure member 254 need only reciprocate from one side of openings 248 to a position generally in registry with openings 248. This type of configuration lends itself to design configurations of the arrangement of openings and of piston travel and configuration to optimize the valve for rapidity of movement between open and closed positions, to facilitate a high density of pulses per time unit. However, other configurations are expressly contemplated. As one example, closure member might move from a first position above openings 248, to a second position closing openings 248, and then to a third position on the opposite side of openings 248.

As another alternative, closure member 254 may move not only between essentially a relatively full "open" position, fully uncovering all openings, and a full "closed" position, fully covering all, or a subset, of openings 248, but may also move to one or more intermediate positions only partially blocking either all or a subset of openings 248. In this type of configuration, valve assembly 230 would be able to generate multiple amplitudes of pulses. As another alternative configuration to achieve multiple amplitudes, openings 248 may be cooperatively arranged with closure member 254 such that only some openings are closed with closure member in a first position, and all openings are closed with closure member 254 in an axially offset position. Different cooperative arrangements of openings 248 and the configuration of closure member 254 can be envisioned to achieve this result. As one example, one or more openings 248 might be arranged to intersect central bore 240 at a first longitudinal position, with one or more other openings 248 arranged to intersect central bore 240 at a nearby, but longitudinally offset, position. Closure member 254 can be configured with a dimension sufficient to block both sets of openings in one position, and with sufficient travel to allow only blocking either set of openings at two additional positions. An additional possible configuration would be for the two sets of openings to define different cumulative flow areas, such that blocking of a first set of openings 248 would block a selected percentage of the total fluid flow, while blocking of the second set of openings 248 would block a different selected percentage of the total fluid flow, thereby enabling at least three pulse amplitudes.

Figure 4:
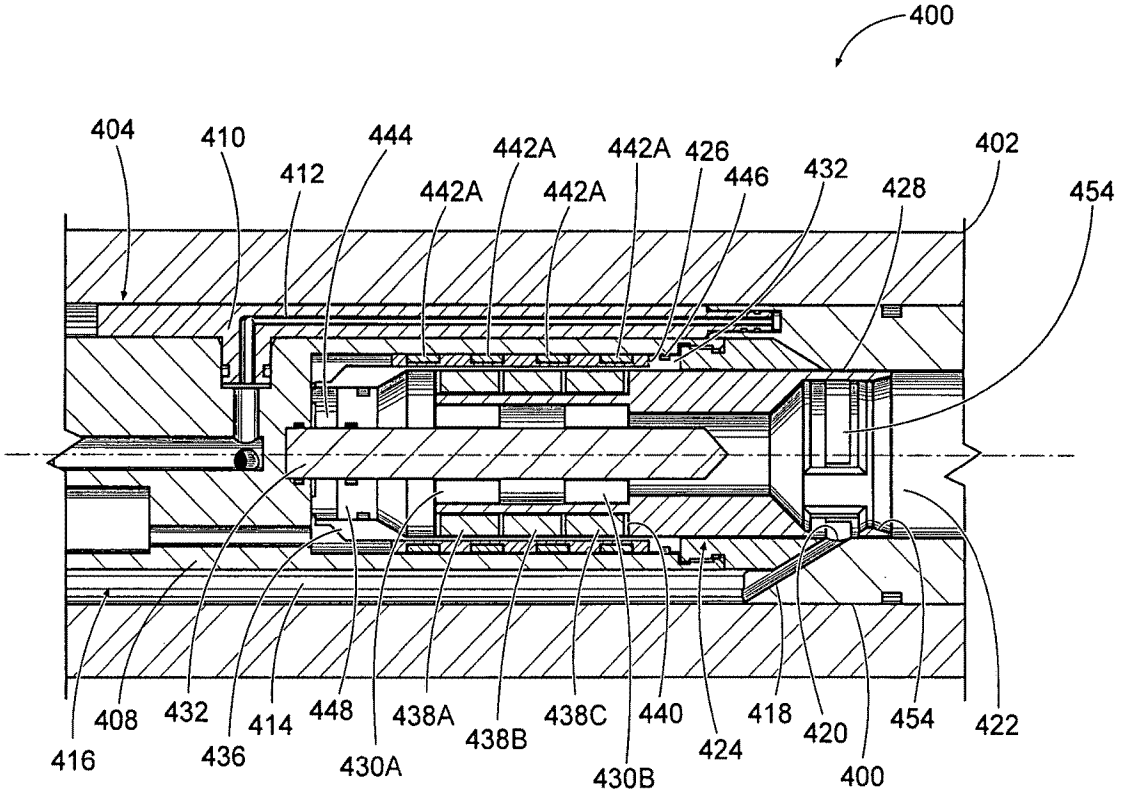
FIG. 4 depicts a vertical cross-section of an alternative embodiment of a mud pulse generator valve assembly.

Referring now to FIG. 4, the figure depicts an alternative configuration of a mud pulse generator valve assembly, indicated generally at 400. Valve assembly 400 is depicted in an operating environment within an outer housing 402. Valve assembly 400 includes a valve housing assembly, indicated generally at 404, sealingly received with an outer housing 402. In the depicted example, housing assembly 404 includes a lower block 406 and an upper block 408. Additionally, a conduit section 410 provides a path 412 for routing electrical conductors into upper block 408 and down through lower block 406 to other devices below valve assembly 400 (only a portion of the path is visible in the depicted cross section). Either upper block 408 or conduit section 410 will be configured to provide a plurality of centralizing ribs (for example three ribs) to maintain the centralized orientation of upper block 408. As with valve section assembly 230 of FIGS. 2 and 3, the centralizing ribs will define a plurality of passageways, as indicated at 414, in communication with the annulus 416 above valve assembly 400, and extending past upper block 408, and terminating in one or more passageways 418 in lower block 406 extending to respective openings 420 in a surface defining at a central bore 422, in a manner generally analogous to valve assembly 230, discussed above.

As can be seen from FIG. 4, valve assembly 400 includes a moveable, generally annular drive piston, indicated generally at 424, having a drive section 426 and an integrally formed closure section 428. Drive section 426 is supported in concentric relation to a guide rod 432 by a pair of bearings 430A, 430B. Drive section 426 extends within a drive housing 434, and where the support of guide rod 432 maintains a close, but spaced relation between adjacent surfaces of drive section 426 and drive housing 436.

Valve assembly 400, like valve assembly 230 of FIGS. 2 and 3, will be electrically actuated, such as though use of one or more voice coil assemblies. Thus, drive section 426 includes a plurality of permanent magnets 438, secured within one or more recesses 440 on the outer diameter of drive piston 442. Drive housing 436 supports a plurality of selectively actuable coils extending in concentric relation to drive piston 442. In the depicted example, drive housing 436 supports four coils 444A-D. The same options for the configuration and control of coils 444A-D discussed relative to valve assembly 230 of FIG. 2C are applicable to this valve assembly 400.

In some examples, coils 444 will be in an oil bath in a sealed chamber 446. Sealed chamber 446 is sealed at a lower extent by a sealed engagement, at 448, between drive housing 430 and upper block 408, and at an upper extent by a seal plate 450. Seal plate 450 sealingly engages both guide rod 432 and drive housing 436. Thus, coils 444 and any other electrical circuitry that may be included within sealed chamber 446, are within oil, and isolated from the well fluid surrounding drive piston 442.

As can be seen from FIG. 4, closure section 428 does not define merely a solid cylindrical sealing surface (as discussed relative to central surface 276 of closure member 254, as depicted in FIGS. 3A-B). Instead, closure section 428 defines a plurality of openings 452 each of which will engage with a respective opening 420 in surface 450 defining a central bore 422. All longitudinally extending surfaces of closure section, including those defining openings 452 and lower surface 454 are again tapered to reduce restrictions on movement through the fluid.

In operation, in a manner as previously described, actuation of the voice coils will cause either forward or backward linear movement of drive piston section, causing closure section 428 to move such that openings 452 are moved into or out of registry with openings 420, thereby selectively relatively opening or blocking flow between openings 420 and central bore 422 to establish pulses in the moving fluid column as described previously.

Figure 5:
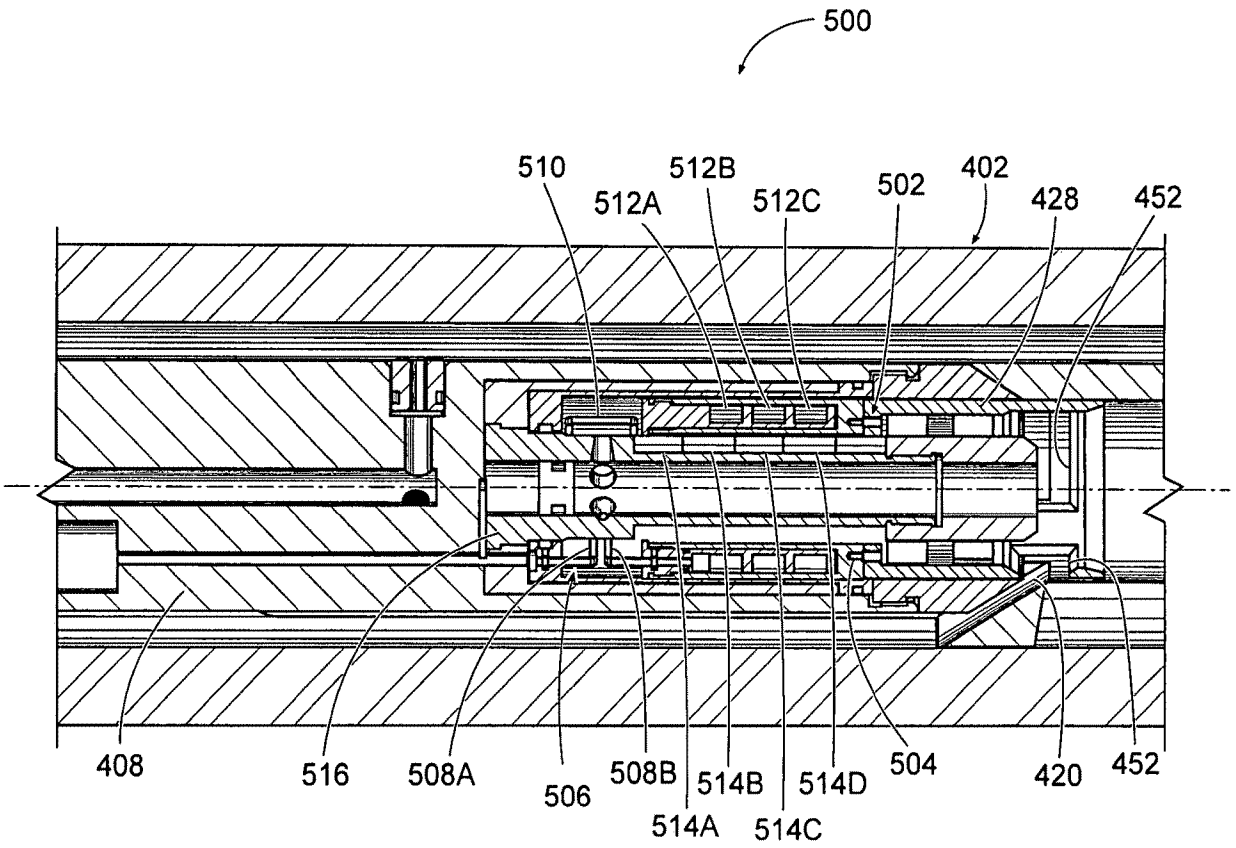
FIG. 5 depicts a vertical cross-section of yet another alternative embodiment of a mud pulse generator valve assembly.

Referring now to FIG. 5, therein is depicted an alternative configuration for a mud pulse generator valve assembly 500, depicted in vertical section. Mud pulse valve 500 shares many structural and operational characteristics with valve assembly 400 of FIG. 4. Accordingly, those similarities will not be specifically addressed here. Components having a structural and functional similarity to components in valve assembly 400 will be numbered similarly in FIG. 5, without implying that such components are fully identical in all respects to those of FIG. 4.

In some example systems, it may be preferable to have a "fail-safe" mechanism, such that if the mud pulse valve were to fail, it would fail in an "open" position in which mud flow through the valve, toward the drill bit or other mechanisms below, would still occur. This result can be achieved by providing a biasing mechanism arranged to bias closure section 428 such that openings 452 are moved into registry with openings 420 thereby opening flow to the passages. This biasing mechanism can be one of various types, such as hydraulic, pneumatic (such as an air chamber serving as a spring) or mechanical. In many example systems the biasing mechanism will be mechanical, including one or more springs, which may be of various configurations.

Valve assembly 500 again includes an electrically actuated drive section, indicated generally at 502, with a generally annular drive piston, indicated generally at 504, that includes a drive section 506 coupled to form a functionally integral unit with closure section 428. A spring assembly 506 extends between a lower portion of upper block 408 and an upper portion of drive piston 504. In the depicted example, spring assembly 506 includes at least one conduit configured to have two spaced legs 508A, 508B separated by a bridge section 510 such that spaced legs 508A-B, when compressed toward one another, provide a bias toward a relatively separated position, in which drive piston 504 is biased to a position, as illustrated, wherein openings 452 of closure section 428 are in registry with openings 420, allowing fluid flow therethrough. When drive piston 504 is electrically actuated to move toward a relatively retracted position, the generally laterally extending legs (relative to a longitudinal axis extending through the valve assembly 500) are compressed towards one another, establishing the bias.

In this example, spring assembly 506 is formed of tubes, which allows spring 506 also serve as a conduit, which can house electrical conductors to facilitate communication with mechanisms on drive piston 504. As noted above, the positions of the permanent magnets and coils can be arranged with either type of component on either the stationary components or movable components of the drive section. In this example, a plurality of coils 512A-C are supported on moveable drive piston 504 while a plurality of permanent magnets 514A-E are supported by the stationary central rod 516. In this configuration, coils 512A-C can receive electrical control signals through conductors extending through the tubes forming spring assembly 506. The electrical conductors will be in communication with electronics section such as described at 226 in FIG. 2C (or relative to element 702 in FIG. 7, later herein). Spring assembly 506 can be formed of any material capable of withstanding the downhole conditions and provided acceptable fatigue resistance to withstand the cycling of the valve assembly. For a tubular spring mechanism as in the example, titanium is contemplated to be an acceptable material. In place of a single spring assembly 506, multiple springs may be used, and the springs may be of configurations other than the example depicted herein. Spring assembly 506 and coils 512A-C will again preferably be in an oil bath, generally as described relative to valve assembly 400 of FIG. 4.

Figure 6:
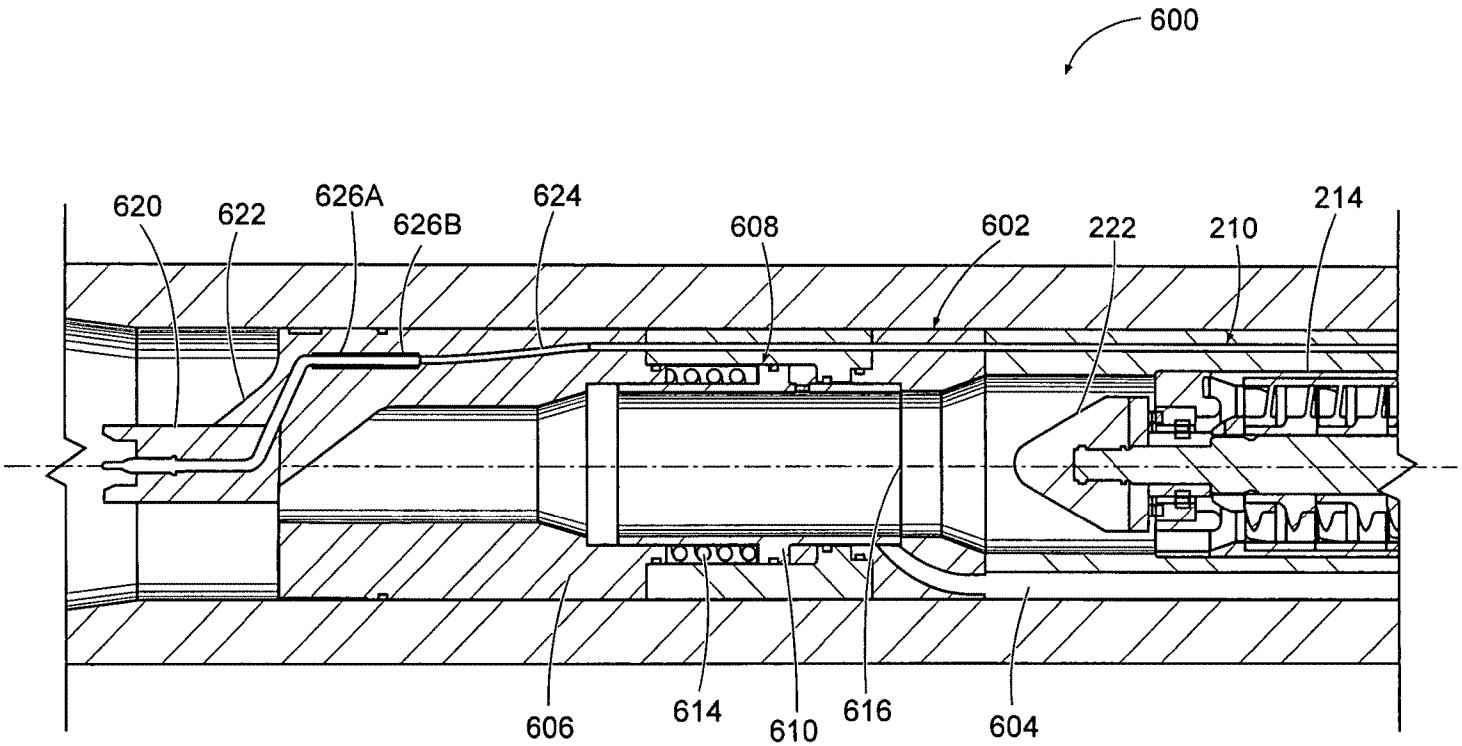
FIG. 6 depicts a vertical cross-section of an alternative configuration for use with a mud pulse generator such as that of FIG. 2C.

As is apparent from the above discussion, in mud pulse generator assembly 200 of FIG. 2C, all of the fluid flow is directed around tapered nose 222 to reach generator assembly 210, and particularly to encounter the vanes thereof, before flowing through passageways 242A, 242B. Referring now to FIG. 6, therein is depicted an upper portion of an alternate mud pulse generator configuration, indicated generally at 600, which may be utilized. In this example, components serving essentially the same functionality as in mud pulse generator 200 of FIG. 2C are numbered similarly. In mud pulse generator 600, in order to allow control of fluid by generator assembly 210, generator assembly is housed within a sleeve assembly 602 that fits within housing assembly 202. Sleeve assembly 602 defines a central bore 616, and an external bypass channel 604.

Generator assembly 210 is housed within central bore 616, which extends longitudinally, past at least multi-stage adjustable flow gear 214, to an exit port (not shown) in communication with an annulus in communication with bypass channel 604. Sleeve assembly 602 includes an upper sub 606 that houses a valve assembly, indicated generally at 608. Valve assembly 608 includes a movable sleeve 610 that is longitudinally movable relative to housing assembly 202, and relative to a bypass port 612. In this example, valve assembly 608 includes a biasing spring 614 arranged to bias movable sleeve 610 into a position closing bypass port 612. Thus, in the depicted example valve assembly 608 is arranged such that all flow will be directed through central bore 616, and thereby to generator assembly 210, in the absence of actuation of the valve to open bypass port 612. Valve assembly 608 may be actuated by any desired actuation mechanism. For example, an electrical control mechanism as described relative to valve assembly 230 in FIG. 2C may be utilized. Alternatively, other actuation mechanisms including other forms of electrical, hydraulic, or mechanical mechanisms may be utilized.

Mud pulse generator 600 and is also configured to allow communication of signals through the device. Accordingly, in this example, upper sub 606 includes a connector 620 supported on a centralizing snorkel 622 to facilitate engagement with a complementary connector centralized within housing assembly 202. In many examples, connector 620 will be an electrical connector, and will be coupled to electrical conductors housed within isolated channel through sleeve assembly 602. In other examples, connector 620 may be an optical connector or a hybrid optical and electrical connector; or may be a hydraulic connector. In the depicted example, snorkel 622 is depicted as a separate component from upper sub 606, and therefore includes a portion of a connector assembly 626A, which engages a complementary connector assembly 626B in upper sub 606. Thus, in a configuration in which connector 620 is an electrical connector, electrical signals may be communicated through conductors within channel 628 of snorkel 622 and through connector assembly 626A-B to conductors within channel 624 (the conductors are not specifically depicted, for clarity).

Figure 7:
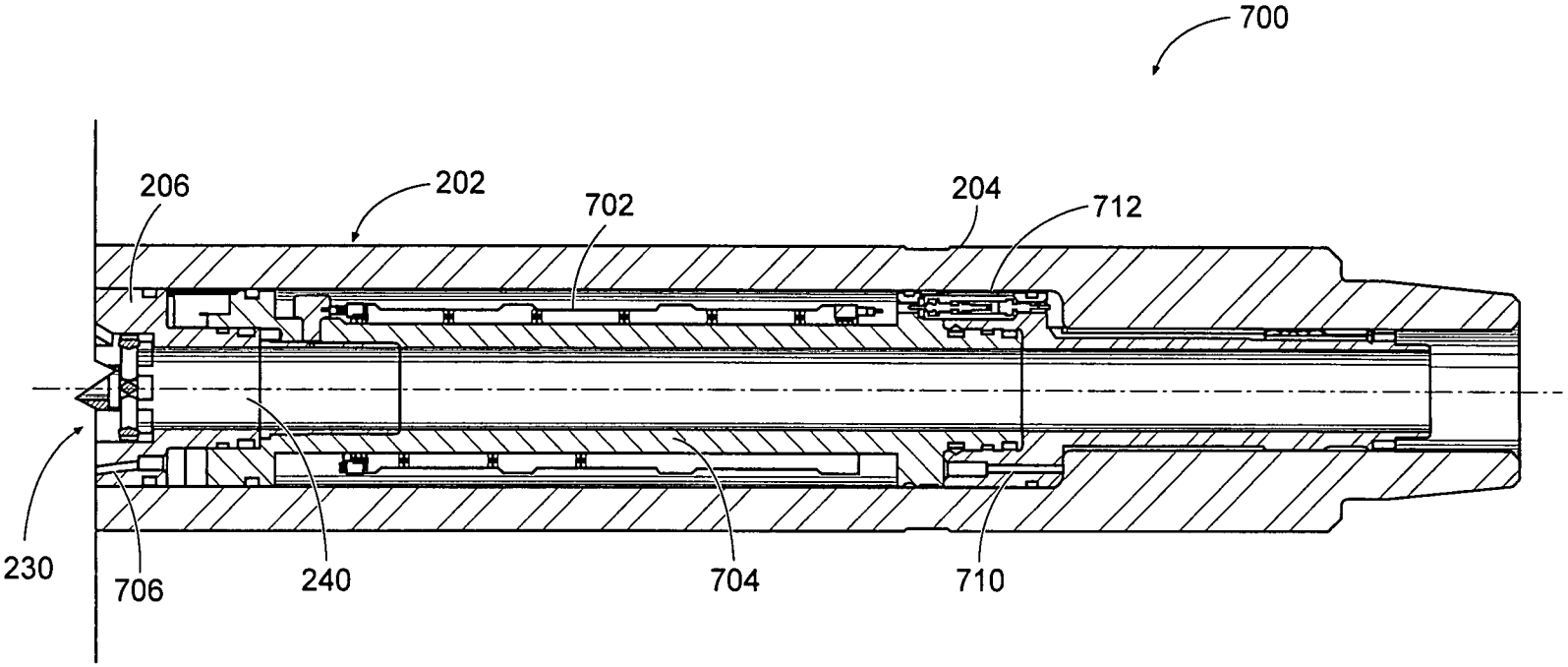
FIG. 7 depicts a vertical cross-section of another alternative configuration for use with a mud pulse generator such as that of FIG. 2C.

As identified above in reference to mud pulse generator assembly 200 of FIG. 2C, other configurations are possible, including the mud pulse valve assembly 230, being arranged at the top of the mud pulse generator, with the remainder of the identified components being located beneath the valve assembly. Referring now to FIG. 7, that figure depicts yet another alternative configuration for a mud pulse generator 700 in which the electronics section (226, as described in reference to FIG. 2C) is divided into two parts. In this example, storage mechanisms, such as capacitors and/or batteries, as previously described will still be located above the valve assembly in a first electronics section as depicted in FIG. 2C (not depicted here). However, other electronics, such as control circuitry and other systems previously described relative to electronics section 226 will be located within a separate electronics section 702 placed below valve assembly 230 (partially depicted). Electronics section 702 is configured to extend concentrically around a fixed sleeve 704 defining a portion of central bore 240 (of FIG. 3A) within a housing assembly 202. Electrical communication is provided through one or more passageways, such as depicted at 706 in valve assembly 700, and through fixed sleeve 704 (passageways not visible in the depicted cross section). Such passageway 706 will preferably extend to reach other passageways in the valve assembly (as depicted at 412 in FIG. 4) to reach at least to the electronics section 226 above the valve assembly; and in some cases will extend to an upper connector (such as depicted at 620 in FIG. 6), to facilitate connection with other tools located above mud pulse generator 700. Additionally, other passageways 710 and/or connectors 712 may be provided to facilitate communication of electronics section 702 and/or other structures above it, with tools located beneath mud pulse generator 700.

Figure 9:
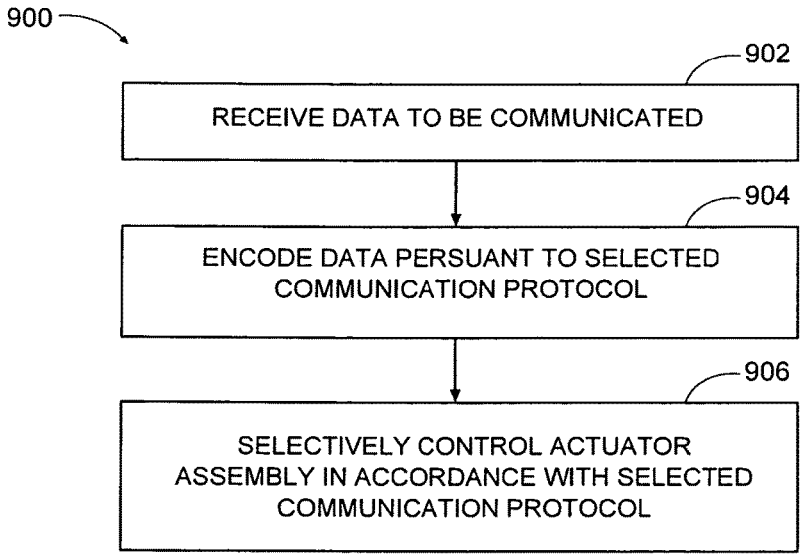
FIG. 9 depicts a flow chart of an example method for using a mud pulse generator valve assembly of any of the types described herein.

Referring now to FIG. 9, the figure depicts a high level flow chart 800 of an example method of operation of any of valve assembly 200, valve assembly 400, or valve assembly 500. As a first step, a controller assembly will receive data to be communicated, as indicated at 902. This receiving of data may be performed in another mechanism such as an MWD or LWD tool in the tool string, or by another control assembly, such that the data may be gathered for transmission by the valve assembly.

Next, the data will be prepared for communication. This will typically include encoding the data pursuant to a selected communication protocol, as indicated at 904. Any of a wide variety of communication protocols for communicating data through a pulse series can be implemented, including frequency-shift keying (FSK), phase-shift keying (PSK), amplitude-shift keying (ASK), and combinations of the above, as well as other communication protocols. An appropriate controller will then control the drive assembly of the valve assembly, as indicated at 906. This functionality can be performed, for example, within a downhole electronics section, as described in reference to FIG. 8. In the case of the described voice coil drive mechanisms, this will include selectively applying current to one or more of the voice coils to cause linear movement of the closure element as described above, in accordance with the selected communication protocol, and a selected data rate. As noted above, for some example valve configurations this can include moving the closure member to positions in addition to (respectively) fully "open" and fully "closed," as may be used to provide one or more additional levels of pulse amplitude. Also as noted above, this actuation can include sequential actuation of multiple coils.

Many variations may be made in the structures and techniques described and illustrated herein without departing from the scope of the inventive subject matter. For example, the alternative structures and operations discussed above with respect to each of valve assembly 230, valve assembly 400 and valve assembly 500 should be understood to be applicable to the other valve assemblies. As just one example, closure member 252 of valve assembly 230 (FIG. 3), could be configured to include a generally solid section and a section with radial openings as depicted relative to closure section 428 at 452. Similarly the alternative configurations as discussed in reference to FIGS. 6 and 7 may be used in systems with any of valve assemblies 230, 400, and/or 500. Additionally, many variations may be made relative to the described example systems in view of the disclosure herein. Accordingly, the scope of the inventive subject matter is to be determined only by the scope of the following claims and all additional claims supported by the present disclosure, and all equivalents of such claims.

We claim:

1. A fluid pulse generator valve, comprising, a housing; a piston chamber within the housing, the piston chamber having a downstream portion; a fluid flow passage within the housing extending around a portion of the piston chamber to intersect the downstream portion of the piston chamber, wherein the fluid flow passage extends inwardly at an angle relative to the downstream portion to intersect the downstream portion of the piston chamber; and a piston disposed within the piston chamber; a drive mechanism operationally coupled to the piston to control movement of the piston over a range of linear movement to selectively obstruct flow at an intersection between the fluid flow passage and the downstream portion of the piston chamber, wherein at least a portion of the piston reciprocates within the downstream portion; and a radial gap between the piston and an inner wall of the piston chamber, whereby some fluid flowing through the fluid flow passage outside of the piston chamber enters the piston chamber regardless of a position of the piston.

2. The fluid pulse generator valve of claim 1, wherein the fluid flow passage comprises a plurality of fluid flow passages extending around a portion of the piston chamber.

3. The fluid pulse generator valve of claim 2, wherein each fluid flow passage intersects the downstream portion at one or more openings in the inner surface of the downstream portion, and wherein the piston selectively obstructs flow through the one or more openings.

4. The fluid pulse generator valve of claim 1, wherein the fluid flow passage is sized to pass particulates that are dispersed in a drilling fluid when flowed through the fluid flow passage.

5. The fluid pulse generator valve of claim 1, wherein the range of linear movement includes a plurality of different positions, each corresponding to a different degree of flow obstruction at the intersection between fluid flow passage and the downstream portion of the piston chamber.

6. The fluid pulse generator valve of claim 1, wherein the drive mechanism is sufficiently powered to clear particulates dispersed in a drilling fluid with the piston when the particulates are present at the intersection of the fluid flow passage with the downstream portion of the piston chamber.

7. The fluid pulse generator valve of claim 1, wherein the piston is sealed with an inner wall of the piston chamber.

8. The fluid pulse generator valve of claim 7, further comprising a dynamic seal isolating at least a portion of a drive mechanism from a fluid flowing in the downstream portion of the piston chamber.

9. A fluid pulse generator valve, comprising: a housing; a piston chamber within the housing, the piston chamber having a portion defined by a surface, wherein a closure member of a piston reciprocates within the portion; a fluid flow passage within the housing extending to intersect the piston chamber at one or more openings in the surface; and the closure member disposed within the piston chamber and linearly moveable within the piston chamber to selectively obstruct flow through the one or more openings in the piston chamber surface, wherein the closure member obstructs flow through the one or more openings when it is radially aligned with the one or more openings, and wherein a radial gap is maintained between the closure member and the piston chamber surface, whereby some fluid flowing through the fluid flow passage outside of the piston chamber enters the piston chamber regardless of a position of the closure member.

10. The fluid pulse generator valve of claim 9, further comprising a drive mechanism comprising an electrical mechanism for moving the closure member over a range of linear movement including a plurality of different positions, each corresponding to a different degree of flow obstruction at the intersection between fluid flow passage and the downstream portion of the piston chamber.

11. The fluid pulse generator valve of claim 9, further comprising a drive mechanism operationally coupled to the piston to control movement of the piston over a range of linear movement including a plurality of different positions, each corresponding to a different degree of flow obstruction at the intersection between fluid flow passage and the downstream portion of the piston chamber, wherein the drive mechanism comprises an electromagnetic mechanism.

12. The fluid pulse generator valve of claim 9, wherein the valve comprises a plurality of fluid flow passages intersecting the portion of the piston chamber.

13. The fluid pulse generator valve of claim 9, wherein the surface is defined by a uniform bore in which the closure member of the piston reciprocates.

14. A fluid pulse generator, comprising:

a housing assembly defining at least one flow passage; and a valve assembly within the housing assembly, the valve assembly including an actuation member operationally coupled to a drive mechanism and moveable over a range of movement along a linear axis, the actuation member including a closure section to open or close a fluid passage opening in an inner surface of the valve assembly that is radially disposed relative to the closure section which reciprocates along the linear axis, and wherein the closure section comprises a generally cylindrical outer surface supported relative to a central hub by a plurality of spokes.

15. The fluid pulse generator of claim 14, wherein a portion of the closure section extends along the linear axis past the fluid passage opening when the valve assembly obstructs flow through the fluid passage opening.

16. A fluid pulse generator, comprising:

a valve assembly defining a flow passage, the flow passage extending to a plurality of openings in a surface defining a uniform bore for an established distance, with the plurality of openings disposed around a perimeter of the surface;

a valve piston having a closure member linearly moveable within the uniform bore, the closure member moveable between a first position allowing flow of fluid between the plurality of openings and the uniform bore, and a second position obstructing the flow of fluid between at least some of the plurality of openings and the uniform bore, and wherein the closure member comprises a generally cylindrical outer surface supported relative to a central hub by a plurality of spokes;

a drive mechanism operably coupled to the valve piston; and a controller operably coupled to the drive mechanism to move the closure member between the first and second positions.

17. The fluid pulse generator of claim 16, wherein the drive mechanism is an electrical mechanism.

18. The fluid pulse generator of claim 16, wherein the closure member is further moveable to at least a third position.

19. The fluid pulse generator of claim 16, wherein the drive mechanism is an electromagnetic mechanism.

20. The fluid pulse generator of claim 19, wherein the electromagnetic drive mechanism includes at least one permanent magnet on a first component and at least one coil on a second component.

21. The fluid pulse generator of claim 16, wherein the controller will actuate the drive mechanism in accordance with at least one protocol selected from a group consisting of: FSK, PSK, ASK, and combinations of the above.

22. The fluid pulse generator of claim 16, wherein the uniform bore has a circular cross-section for the established distance.

23. A fluid pulse generator, comprising:

a housing;

a piston chamber within the housing, the piston chamber having a portion defined by a surface;

a fluid flow passage within the housing extending to intersect the piston chamber at one or more openings in the surface;

a piston disposed within the piston chamber and linearly moveable within the piston chamber along a linear axis to selectively obstruct flow and allow flow through the one or more openings in the piston chamber surface, wherein the piston comprises closure member having a generally cylindrical outer surface supported relative to a central hub by a plurality of spokes;

a drive mechanism operably coupled to move the piston between positions to obstruct or allow flow through the one or more openings;

a power source; and a controller coupled to the power source and drive mechanism to control the drive mechanism to move the piston to generate a series of fluid pulses.

24. The fluid pulse generator of claim 23, further comprising a plurality of fluid flow passages within the housing and extending to intersect the piston chamber at the one or more openings.

25. The fluid pulse generator of claim 23, wherein the fluid flow passage extends around a portion of the piston chamber to radially intersect the portion of the piston chamber.

26. The fluid pulse generator of claim 23, wherein a portion of the drive mechanism is radially disposed relative to a portion of the piston.

27. The fluid pulse generator of claim 24, wherein a portion of the drive mechanism extends concentric to a portion of the piston.

28. A method of generating fluid pulses in a fluid column, comprising:

actuating a fluid pulse generator disposed in a tool string within a wellbore, the tool string containing the fluid column, the fluid pulse generator comprising, a housing assembly defining a flow passage, the flow passage extending to a plurality of openings disposed in a surface defining a generally uniform bore for an established distance;

a valve assembly having a closure member linearly moveable within the generally uniform bore, the closure member supporting a sealing surface, wherein the closure member is moveable between a first position in which the sealing surface allows relatively free flow of fluid between the plurality of openings and the generally uniform bore, and a second position in which the sealing surface relatively restricts the flow of fluid between the plurality of openings and the bore; and a drive mechanism operably coupled to the closure member to move the closure member between the first and second positions; and wherein actuating the fluid pulse generator comprises, receiving information to be communicated through the fluid column, encoding the information in accordance with a selected communication protocol, and controlling the drive mechanism to move the closure member in accordance with the encoded information to generate a corresponding series of fluid pulses in the fluid column.

29. The method of claim 28, wherein the closure member is further movable to a third position, and wherein the drive mechanism is further operable to move the closure member to the third position as well as to the first and second positions.

30. The method of claim 29, wherein controlling the drive mechanism further comprises:

receiving feedback inputs from sensors outside the valve assembly, and adjusting the drive mechanism in response to such feedback.

* * * * *